US005291256A

United States Patent [19]

Kitajima et al.

[11] Patent Number: 5,291,256

[45] Date of Patent: Mar. 1, 1994

[54] IMAGE FORMING APPARATUS HAVING OPENING MECHANISM FOR JAM CLEARANCE

[75] Inventors: Kazushi Kitajima; Tamotsu Okada, both of Kawasaki, Japan

[73] Assignee: Canon Kabushiki Kaisha, Tokyo, Japan

[21] Appl. No.: 787,252

[22] Filed: Nov. 4, 1991

[30] Foreign Application Priority Data

Nov. 2, 1990 [JP] Japan ..... 2-298413
Nov. 30, 1990 [JP] Japan ..... 2-333809
Apr. 9, 1991 [JP] Japan ..... 2-076276

[51] Int. Cl.[5] ..... G03G 15/20
[52] U.S. Cl. ..... 355/290; 355/200
[58] Field of Search ..... 355/200, 282, 285, 289, 355/290, 295, 210, 211; 219/216

[56] References Cited

U.S. PATENT DOCUMENTS 4,531,823 7/1985 Deguchi et al. ..... 355/308
4,598,990 7/1986 Kusumoto et al. ..... 355/290
4,682,878 7/1987 Takizawa et al. ..... 355/309
4,884,110 11/1989 Tsurubuchi et al. ..... 355/319
4,954,845 9/1990 Yano et al. ..... 355/290
4,998,121 3/1991 Koh et al. ..... 346/160
5,026,276 6/1991 Hirabayashi et al. ..... 432/59
5,027,160 6/1991 Okada et al. ..... 355/282
5,043,763 8/1991 Koh et al. ..... 355/206
5,045,887 9/1991 Nakamura ..... 355/282
5,051,784 9/1991 Yamamoto et al. ..... 355/285
5,083,168 1/1992 Kusaka et al. ..... 355/285
5,091,752 2/1992 Okada ..... 355/285
5,099,289 3/1992 Kurotori et al. ..... 355/290
5,105,228 4/1992 Kato ..... 355/282
5,111,250 5/1992 Kashiwagi ..... 355/285

*Primary Examiner*—Lincoln Donovan
*Assistant Examiner*—Christopher Horgan
*Attorney, Agent, or Firm*—Fitzpatrick, Cella, Harper & Scinto

[57] ABSTRACT

An image forming apparatus includes image forming device for forming an unfixed image on a recording material; a fixing device for fixing the unfixed image on the recording material, the fixing device including a heater which is stationary in use, a film in sliding contact with the heater and a pressing member cooperative with the film to form a nip for receiving the recording material, and an opening portion for opening the apparatus for permitting jam clearance operation of the recording material in the fixing device. The pressing member and the film are separated from each other in association with opening of the opening portion.

23 Claims, 11 Drawing Sheets

IMAGE FORMING APPARATUS HAVING OPENING MECHANISM FOR JAM CLEARANCE

FIELD OF THE INVENTION AND RELATED ART

The present invention relates to an image forming apparatus wherein an unfixed image is formed on a recording material and is thereafter fixed.

In conventional image forming machines, heat roller type fixing apparatus is widely used. A different type is disclosed in U.S. Ser. Nos. 206,767, 409,341 (now issued as U.S. Pat. No. 5,043,763), U.S. Ser. No. 416,539 (now issued as U.S. Pat. No. 4,998,121), U.S. Ser. No. 426,082 (now issued as U.S. Pat. No. 5,026,276), U.S. Ser. Nos. 435,247, 430,437 (now issued as U.S. Pat. No. 5,083,168), U.S. Ser. Nos. 440,380, 440,678, 444,802, 446,449 (now issued as U.S. Pat. No. 5,027,160), U.S. Ser. Nos. 450,560, 496,957, 502,223, 542,064 (now issued as U.S. Pat. No. 5,051,784), U.S. Ser. Nos. 542,018, 542,068, 542,067 and U.S. Pat. No. 4,954,845 or the like in which a quick response thermal head and a thin film in sliding contact with the thermal head are used. Referring to FIG. 1, there is shown an example of an image forming apparatus using the heating apparatus having the thin film as an image fixing apparatus. It comprises a sheet feeding station 1, an image forming station 2, a sheet conveying station 3, a low thermal capacity heater 4, a thin film 5, a backup or pressing roller 6, sheet discharging rollers 7, a tray 8, an outer casing 9, a photosensitive drum 10 rotatable in the direction indicated by an arrow b, an original carriage reciprocable in a direction indicated by an arrow a and a lower frame 16. This apparatus involves a disadvantage that the sheet jam clearance operation is difficult and the surface of the thin film is easily damaged. Therefore, upon the jam clearance operation, the film surface may be damaged by contact with the recording material with the result of local improper image fixing. In a method, the sheet discharging side is opened to make the jam clearance operation easier in the fixing station. However, it is possible that the operator damages the film. When the recording material is heated concentratedly at the nip in the heating apparatus shown in FIG. 1, the temperature at a portion away from the nip is low, and therefore, it is provable that the operator contacts it. In the case of the heating roller type system, the operator may be damaged if the operator contacts the heating roller.

SUMMARY OF THE INVENTION

Accordingly, it is a principal object of the present invention to provide an image forming apparatus wherein the damage of the film surface with the contact by the recording material is prevented during the jam clearance operation.

It is another object of the present invention to provide an image forming apparatus in which the operator can carry out the jam clearance operation without contact to the film.

It is a further object of the present invention to provide an image forming apparatus wherein a pressing member and a film are spaced apart in association with an opening operation for the purpose of jam clearance.

It is a further object of the present invention to provide an image forming apparatus in which the pressing member side can be opened without uncovering the film.

It is a further object of the present invention to provide an image forming apparatus provided with an opening portion for opening the bottom portion of the image fixing means, at the bottom frame thereof.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
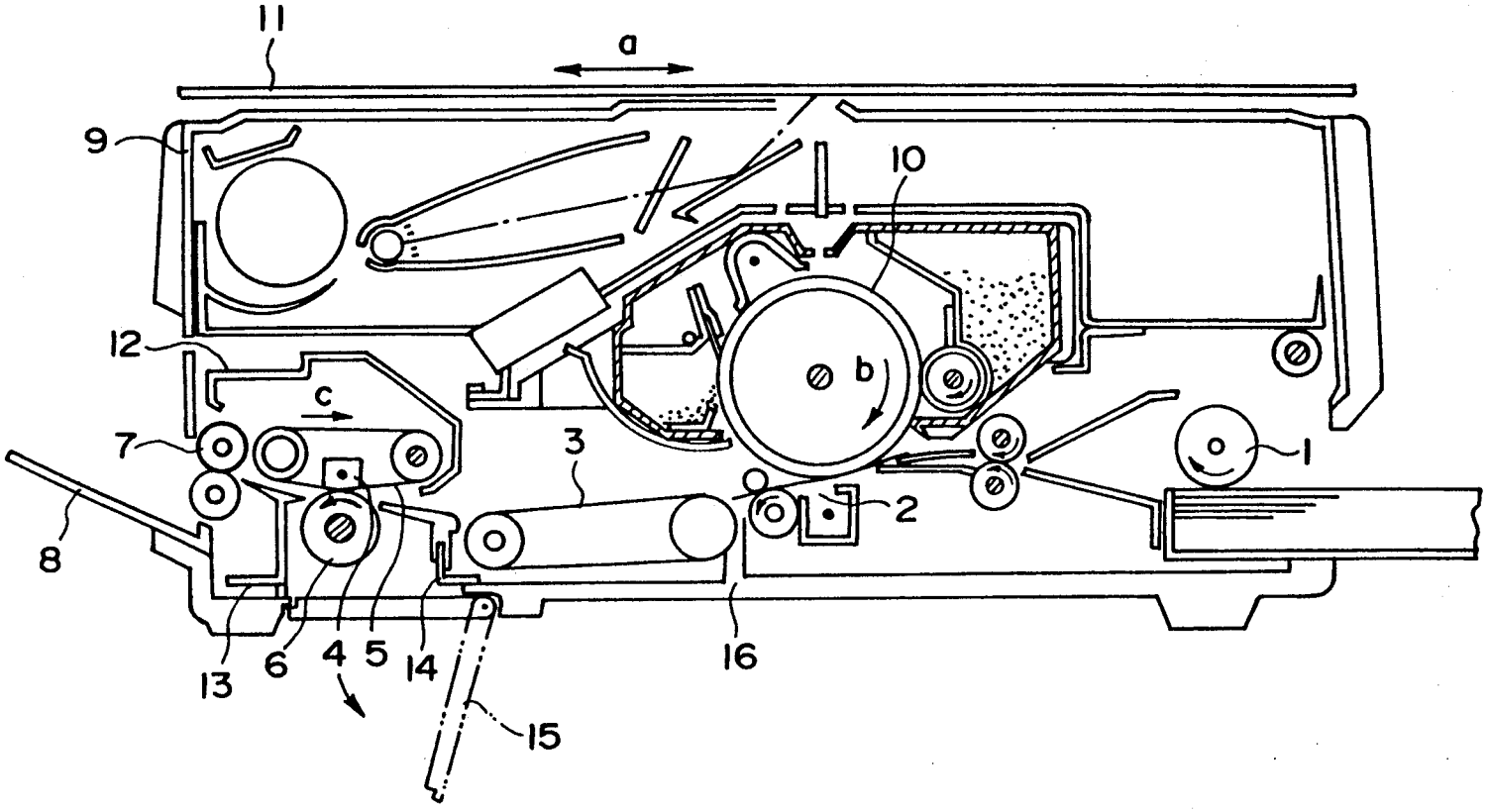
FIG. 2 is a sectional view of an image forming apparatus according to an embodiment of the present invention.
Figure 3:
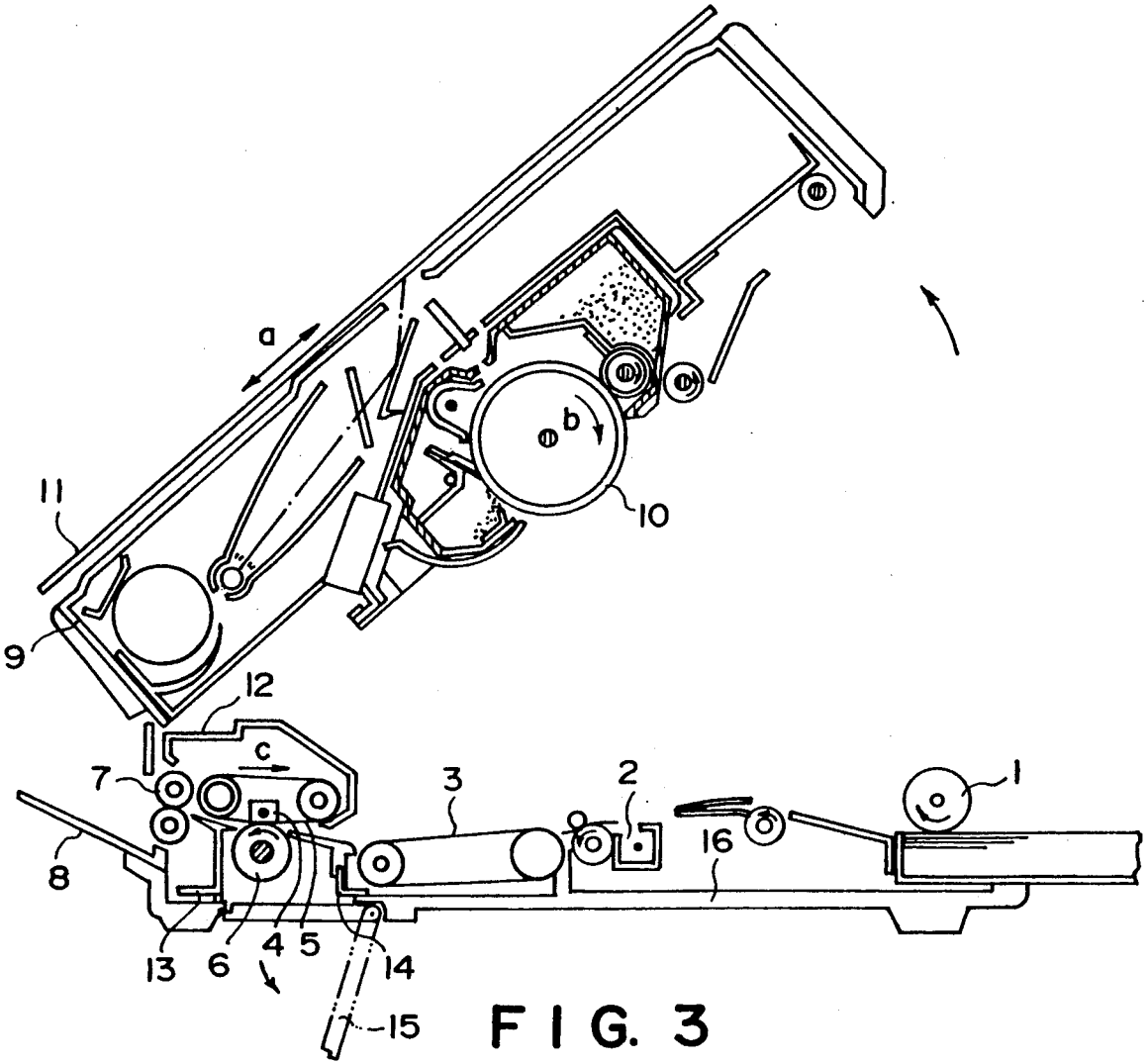
FIG. 3 is a sectional view of the apparatus of FIG. 2 when it is divided into its upper and lower units.

Referring to FIG. 2, there is shown an image forming apparatus in a cross-section according to a first embodiment of the present invention. FIGS. 2 and 3 are sectional views of the same apparatus in which the apparatus is opened for the purpose of jam clearance operation.

Figure 1:
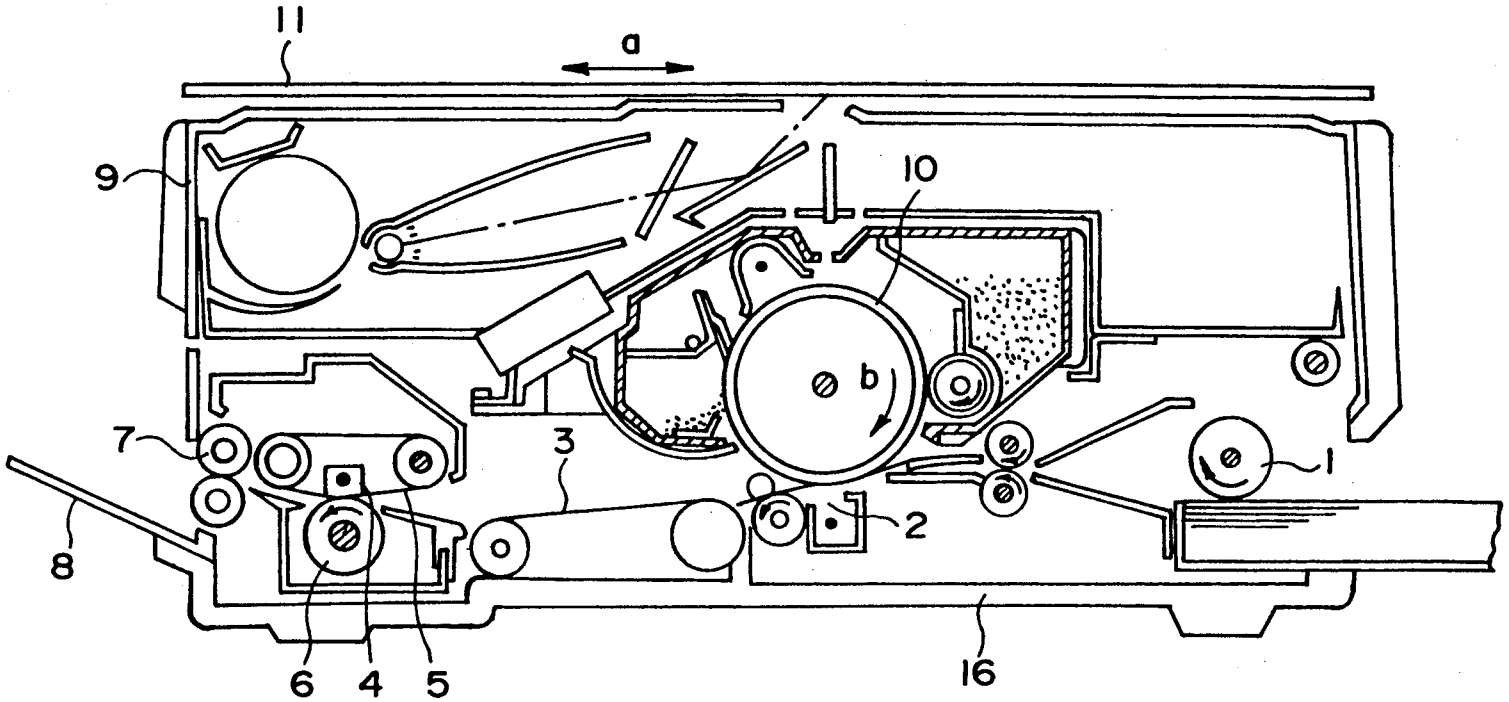
FIG. 1 is a sectional view of an image forming apparatus having a heating device using a thin film.

In FIGS. 2 and 3, the elements 1–11 and the element 16 are the same as shown in FIG. 1. The apparatus comprises a top cover 12 for the image fixing device, a sheet discharge guide 13, an inlet guide 14, and a door 15 provided on the bottom frame 16 to open the bottom part of the fixing device.

Referring to FIG. 2, the recording material fed from the sheet feeding station 1 receives an unfixed toner image at the image forming station 2, and is introduced into the fixing device by the conveying device 3. The image forming station of this embodiment comprises known elements for effecting electrophotographic process using the photosensitive drum 10 rotating in the direction indicated by the arrow b, and therefore, the detailed description thereof is omitted for simplicity. The fixing device comprises a low thermal capacity heater 4 which is fixed and is stationary in use, a thin film 5 in sliding contact with the heater 4 and rotatable in a direction c, and a pressing roller 6 for pressing the recording material to the heater 4.

The heater 4 comprises a resistor producing heat upon electric power supply thereto, and high thermal conductivity alumina base plate (insulative) for supporting the resistor on its bottom surface (closer to the film). The thin film 5 comprises a heat resistive resin base layer of polyimide and a surface parting layer of fluorine resin material having a thickness less than that of the base layer, the surface layer being on the base layer. If the film 5 has a large thickness, the thermal conductivity decreases, and therefore, it is preferably not more than 100 microns, and further preferably, not more than 40 microns.

The recording material carrying an unfixed powder toner image formed at the image forming station 2, is passed through a nip formed between the thin film (fixing film) 5 and the pressing roller 6. During the passage, the image is fixed by the heat from the heater 4 and the pressure from the pressing roller 6. After the image fixing operation, the recording material is discharged to the outside of the apparatus by the discharging rollers 7, and is stacked on the tray 8. The outer cover 9 is provided with an opening for permitting passage of the recording material.

As shown in FIG. 3, after the original carriage 11 is locked, an upper unit containing the photosensitive drum, and the process means such as the primary charger, the developing device and the cleaner or the like can be lifted opened while retaining in the lower unit the sheet feeding station 1, the conveying station 3, the fixing device and the transfer charger. By doing so, the recording material jam clearance operation is permitted in the image transfer station and the recording material conveying station 3. Also, the maintenance or servicing operation in the image forming station is permitted.

The pressing roller 6 which is one of a movable member of the image fixing means is exposed or uncovered by opening the door provided on the bottom frame 16 of the image forming apparatus. The thin film 5 which is another movable member of the fixing means and the low thermal capacity heater which is at a high temperature, are enclosed by an image fixing top cover 12 having heat insulating nature, an inlet guide 14 for guiding the recording material to the fixing position, a sheet discharge guide 13 for guiding the recording material to the discharging rollers 7 and the like. Therefore, they are not exposed without disassembling the apparatus by removing screws or the like. Thus, the movable members and the heater in the fixing station are not exposed.

When the door 15 is opened for the purpose of jam clearance, maintenance or the servicing, the heater 4 having the high temperature and the thin film 5 which is the other movable member, are not exposed by the pressing roller which is another movable member, the inlet guide 14 and the sheet discharging guide 13.

For the purpose of further safety, the surfaces of the inlet guide 14 and the sheet discharging guide 13 which may be contacted by the operator's hands when the door 15 is opened, may be protected by planting fibers, by employing protection cover or covers so as to prevent direct contact. In the first embodiment, the operator is prevented by top cover 12 from having direct contact with the low thermal capacity heater 4 having the high temperature and the thin film 5 which may be easily damaged during the jam clearance operation. Accordingly, the operator's hands and the thin film 5 are protected from burning or tearing. If the recording material is jammed by wrapping around the movable member, the door 15 is opened, by which the pressing roller 6 which is the one of the movable members is uncovered to facilitate the jam clearance operation.

In the above structure, said other movable member is in the form of a thin film 5. In this case, the jamming of the sheet wrapped around the movable member can be sufficiently cleared by the jam clearance operation at the pressing roller side, because such jamming occurs when the pressing roller 6 is cool immediately after the start, and therefore, the sheet is relatively easily wrapped around the roller side.

Figure 4:
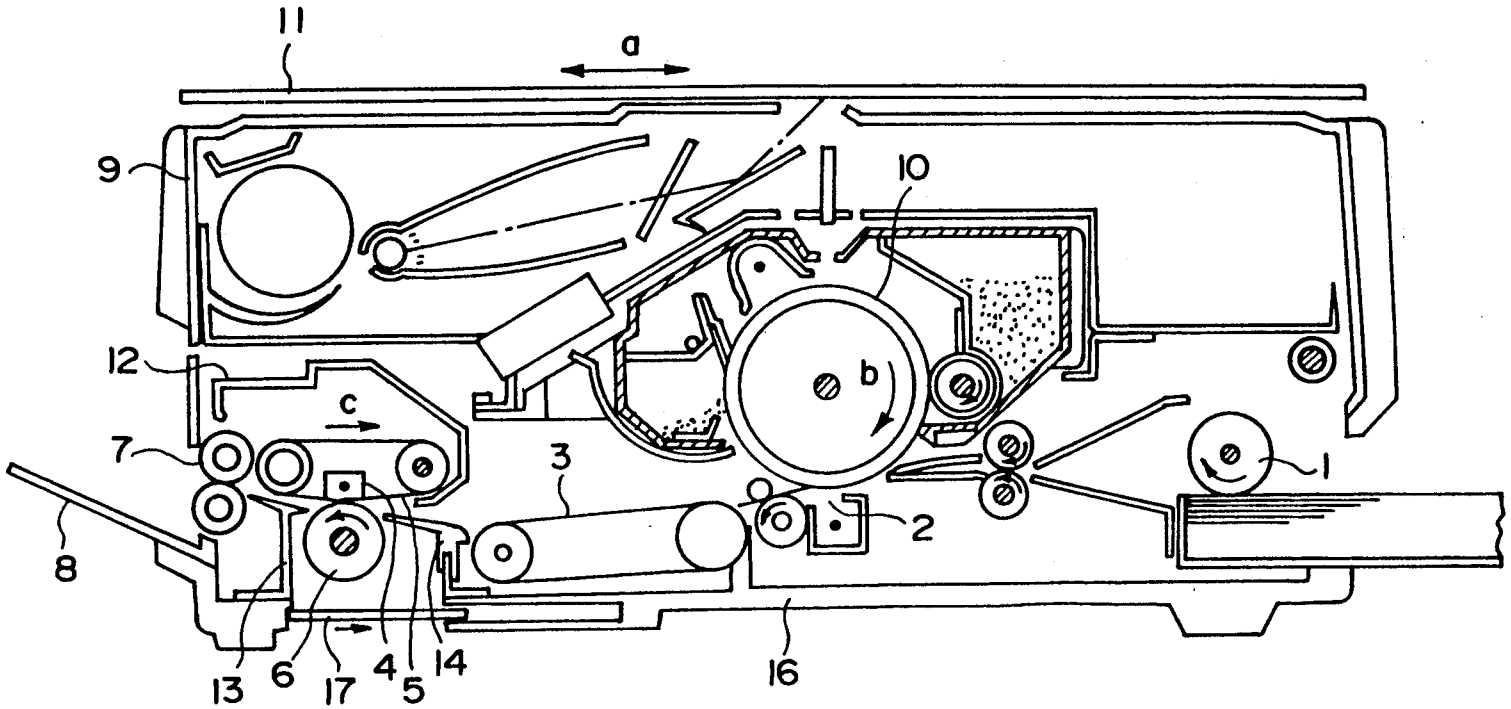
FIG. 4 is a sectional view of an image forming apparatus according to a second embodiment of the present invention.

FIG. 4 shows an image forming apparatus according to a second embodiment of the present invention. In this embodiment, the bottom frame 16 is provided with a sliding door 17 in order to permit the pressing roller, which is one of the movable members of the image fixing means, to be exposed. When the sliding door 17 is opened, the power source is deactuated, and the door is locked so as to prevent obstruction of the door 17 to the jam clearance operation.

Figure 5:
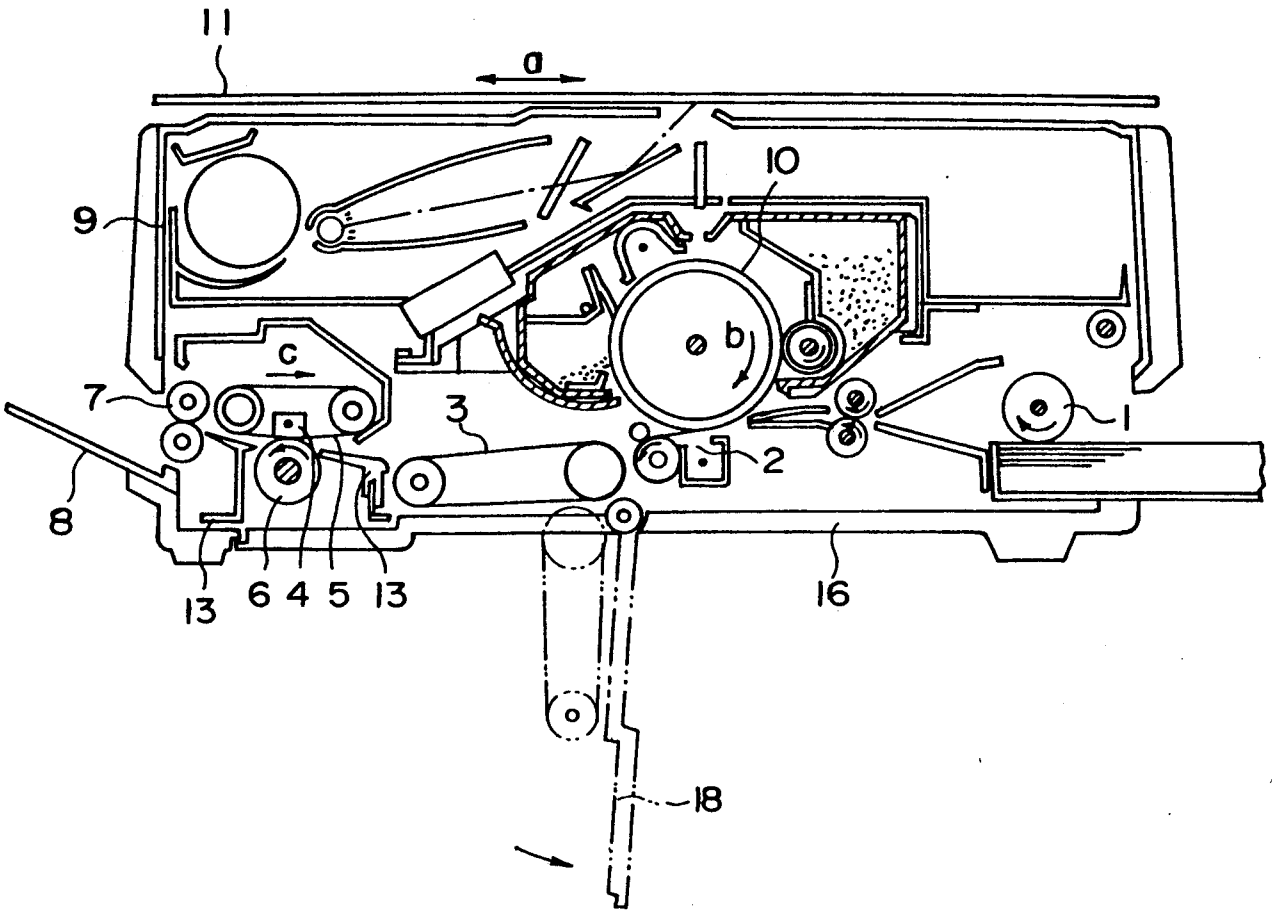
FIG. 5 is a sectional view of an image forming apparatus according to a third embodiment of the present invention.

FIG. 5 shows an image forming apparatus according to a third embodiment of the present invention.

In the third embodiment, the door is relatively large to permit the conveying portion 3 to be opened. Thus, the jammed recording material in the region from the conveying station 3 to the fixing station, can be removed when the door 18 is opened. The jam clearance operation becomes possible simply by opening the door 18 without the necessity of opening the upper frame of the image forming apparatus to confirm the location of the jammed sheet as in the case of the jamming in the image forming apparatus.

Figure 6:
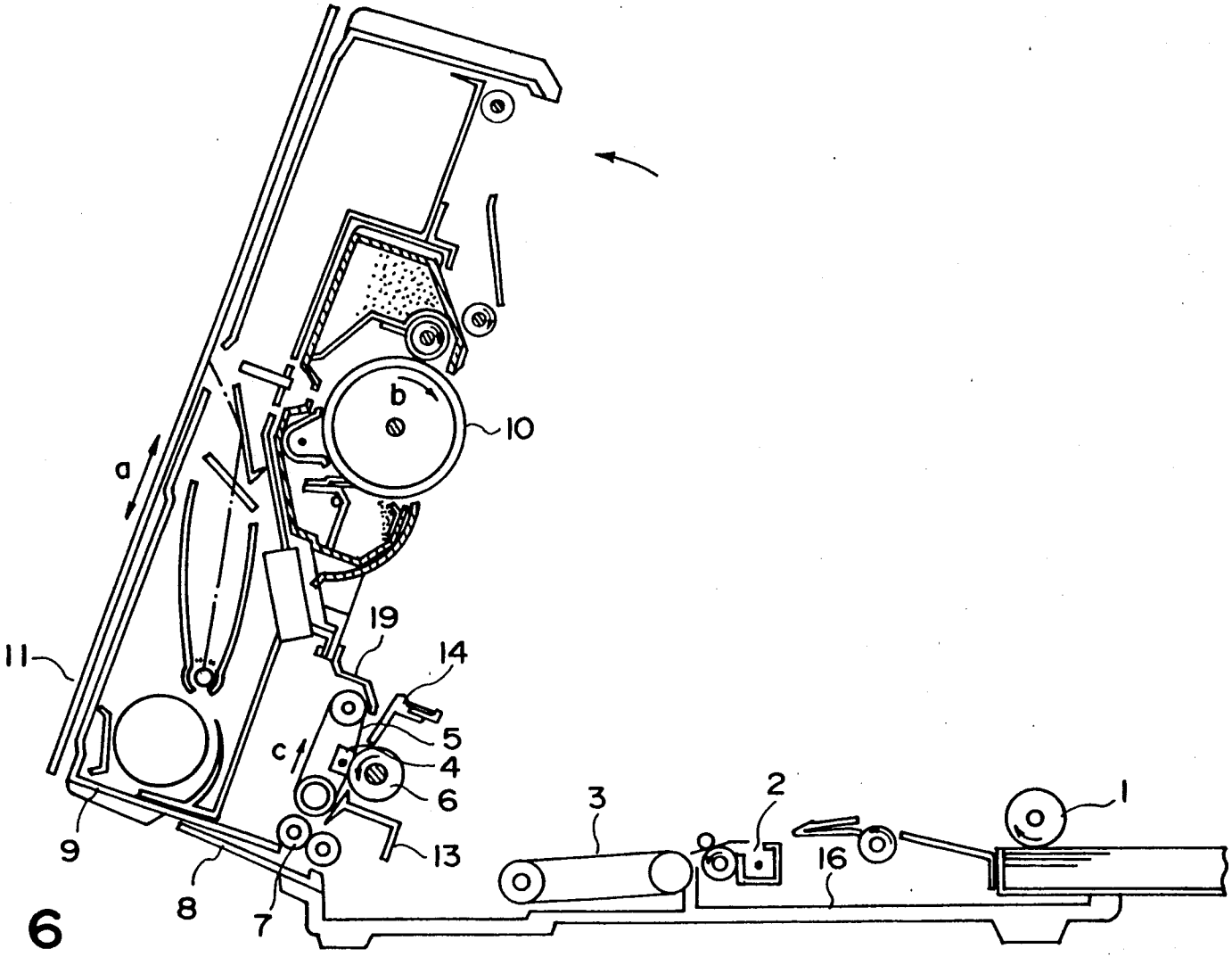
FIG. 6 is a sectional view of an image forming apparatus according to a fourth embodiment of the present invention.

FIG. 6 shows an image forming apparatus according to a fourth embodiment of the present invention. In this embodiment, both of the movable members of the image fixing means, the inlet guide 14 and the sheet discharging guide 13 are contained in the upper frame of the image forming apparatus. In this structure, the upper frame is openable relative to the bottom frame so as to allow maintenance operations such as replacement of elements or replenishment of the toner or the like for the photosensitive drum 10, the developing device and the cleaner. The mechanism for this purpose also functions as the mechanism for exposing one of the movable members of the fixing means. Therefore, the movable member can be exposed without additional mechanism. This increases the reliability of the apparatus and reduces the manufacturing cost. In addition, the top cover is not required to cover the entirety of the fixing means, and therefore, it may be a small and simple member such as a film protection plate 19. Similarly to the third embodiment, the jam clearance operation is possible by only one opening action, and therefore, it is not necessary to stand the main assembly.

The present invention is not limited to the apparatus using the fixing film (the thin film 5) as in the foregoing embodiments, but the present invention is applicable to the heating roller or heating belt type fixing device. Also, the present invention is applicable to various types image forming machines. The image forming station is not limited to the electrophotographic type as described hereinbefore. It is also usable with an electrophotographic process such as magnestylus type or the like.

Figure 7:
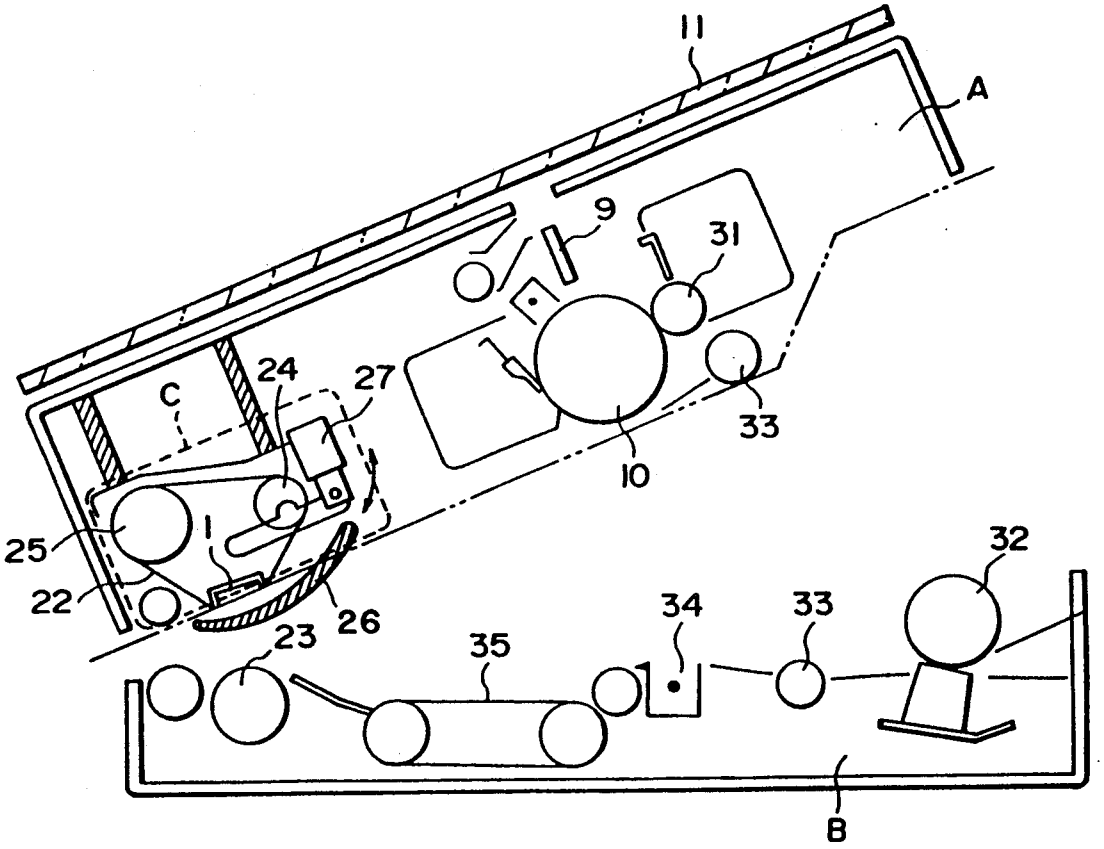
FIG. 7 is a sectional view of an image forming apparatus according to a fifth embodiment of the present invention.

Referring to FIG. 7, a fifth embodiment of the present invention will be described. In FIG. 7, the fixing device comprises a heater 21 fixed on the fixing device, an image fixing film 22 in the form of an endless belt having a small thickness and having heat durability, and a pressing roller 23.

The fixing film 22 is tensioned with the follower roller 24, and is rotated with a driving roller 25. A lateral position of the fixing film 22 is detected by an unshown detecting means, and in response to the output of the detecting means, one longitudinal end portion of the follower roller 24 is moved up and down, so that the lateral shifting of the fixing film 22 is prevented. The up and down movement is effected by a control arm 26 and a solenoid 27 for driving it.

An image of an original on the original carriage 8 is projected onto the photosensitive drum 10 through a short focus imaging element array SLA 19 so that an electrostatic latent image is formed on the photosensitive drum. The latent image is developed by the developing station 31 into a toner image. On the other hand, a recording material is fed to the transfer station 34 where a toner image is transferred onto the recording material. The recording material now having the unfixed toner image is introduced into the above-described image fixing device by a conveyer belt 35.

In this embodiment, the apparatus is divisible into the upper unit A and the lower unit B. A film unit C comprising the film moving means and the lateral shift control means, is supported on the upper unit A.

By doing so, even if the apparatus is installed on non-flat floor or table, the possible twisting force to the apparatus is absorbed only by the lower or bottom unit B. Therefore, the twisting influence to the upper unit A and the film unit C can be reduced. The bottom unit B receives the entire weight of the apparatus, and therefore, it is easily influenced by twisting force resulting from the non-flat table, but the upper unit A is free from the twisting action. Therefore, the influence to the film unit C is minimized.

Figure 8C:
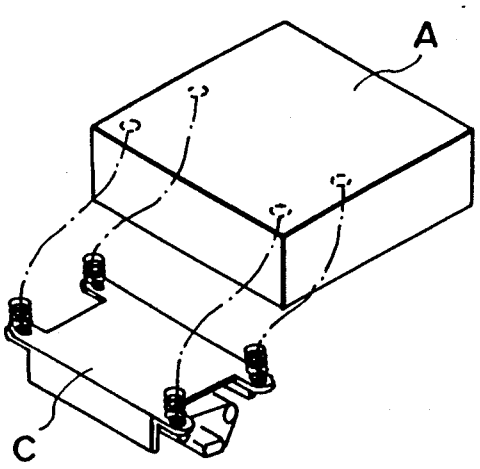
FIGS. 8A, 8B and 8C show the mounting of the film unit to an upper unit.
Figure 8B:
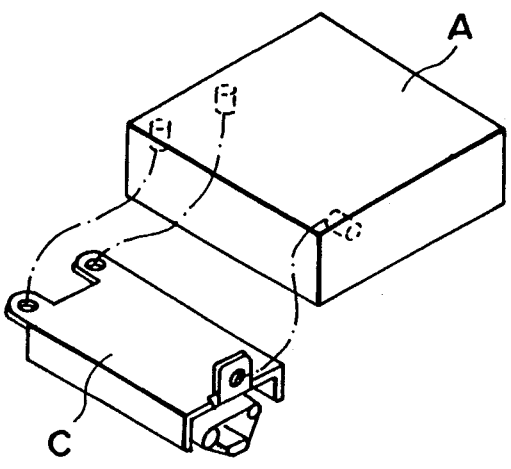
Figure 8A:
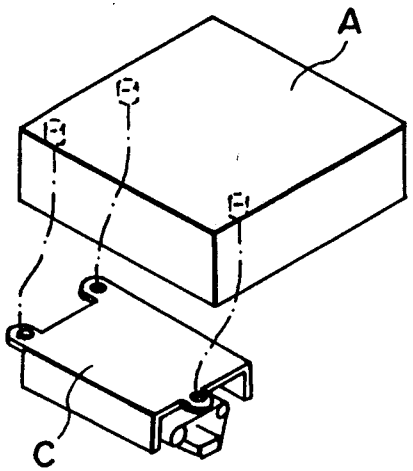

The film unit C is fixed on the upper unit A by three point supporting system (FIG. 8A), by rotational support (FIG. 8B) or elastic member support (FIG. 8). When the upper unit A is opened relative to the lower unit B to carry out the jam clearance or maintenance operation, the film and the pressing roller are completely separated. Therefore, even if the jammed recording material is pulled out, the recording material does not slide relative to the film with the pressure.

When the apparatus is opened, the film does not move due to the load such as the driving roller or the like.

In the structure in which the film does not move when the apparatus is opened for the purpose of jam clearance operation or the like, it is particularly advantageous to effect separation between the film and the pressing roller in interrelation with the opening of the apparatus or the opening portion.

A shutter 37 may be employed to protect the fixing film 22 only upon the opening. Then, the fixing film may be protected with further certainty, and the operator is further protected because the film unit C having the high temperature can be covered.

Figure 9:
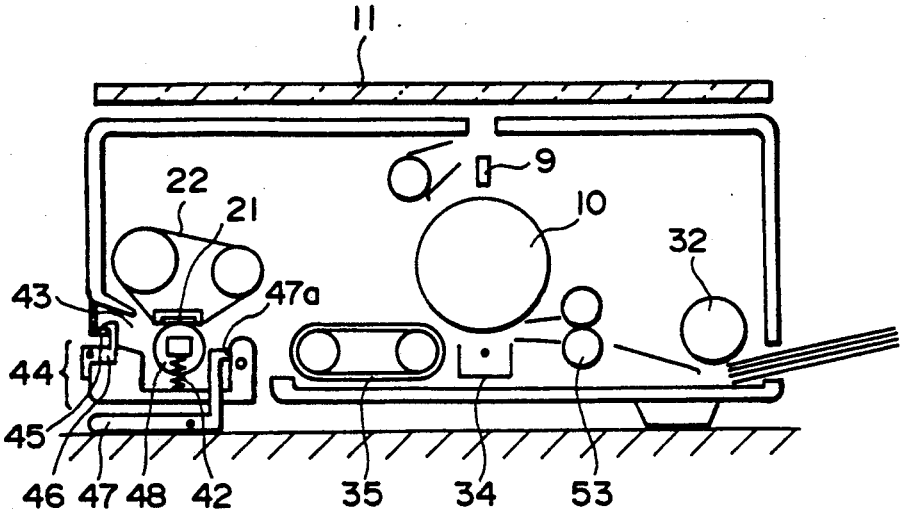
FIG. 9 is a sectional view of an image forming apparatus according to the sixth embodiment of the present invention when it is in use.
Figure 10:
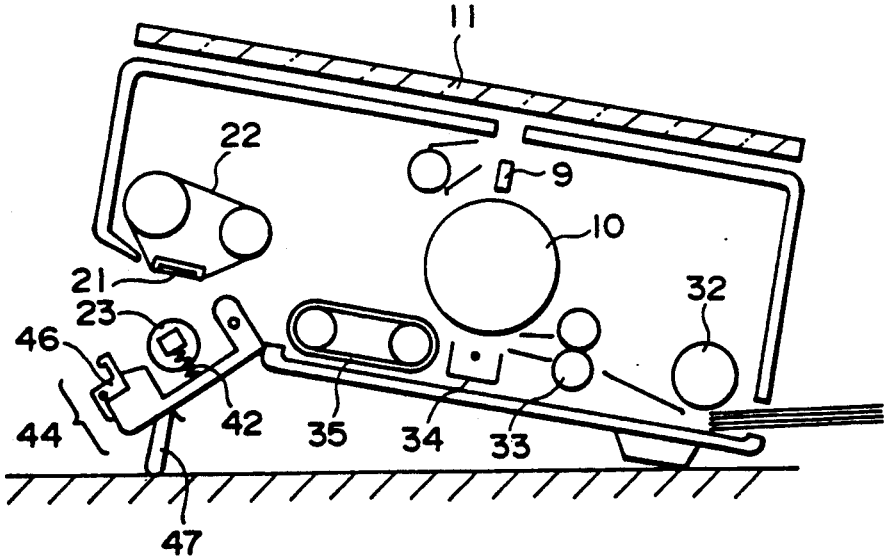
FIG. 10 is a sectional view of the image forming apparatus of FIG. 9 in the state of jam clearance operation.

Referring to FIGS. 9 and 10, a sixth embodiment of the present invention will be described. FIG. 9 shows the state in usual operation, and FIG. 10 shows the state during the jam clearance operation.

The pressing roller 23 is supported on a jam clearance unit 44 which is openable from the main assembly of the apparatus. The jam clearance unit 44 is provided with an opening lever 46 having a pawl engageable with a projection 45 from the main assembly. Usually, the projection 45 and the pawl are engaged to prevent opening.

The bottom portion of the main assembly is provided with a rotatable lever 47 for providing a space between the floor surface and the bottom of the main assembly. An end 47*a* of the lever 47 prevents the opening of the jam clearance unit 44.

Thus, only when the lever 47 takes the jam clearance position (FIG. 10), the jam clearance unit 44 is openable.

More particularly, as shown in FIG. 10, upon jam occurrence, the lever 47 is rotated in the counterclockwise direction, by which the main assembly is inclined about a pivot axis adjacent the sheet feeding side so as to provide a space between the main assembly an the floor surface. Then, the opening lever 46 is operated, and the jam clearance unit 44 is opened.

After the jam clearance operation, the reverse actions are carried out to permit the image forming operation to be resumed. An unshown detecting means such as microswitch or the like may be used to deactuate the power source of the main assembly when the lever 47 and the jam clearance unit 14 are set at the positions shown in FIG. 10.

Figure 11:
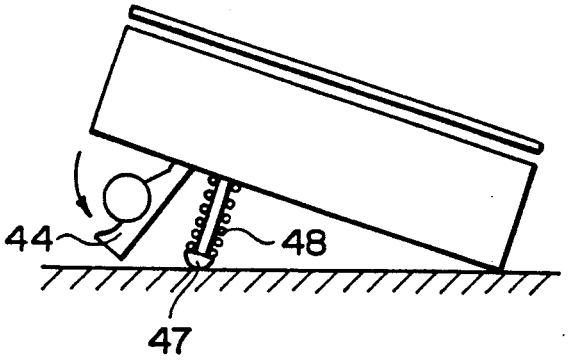
FIG. 11 is a side view of an image forming apparatus according to a seventh embodiment of the present invention.

FIG. 11 shows a seventh embodiment. In the Figure, only the bottom portion of the apparatus is shown, and the other portions are omitted for the sake of simplicity.

In the seventh embodiment, the lever 47 is not a rotatable type, but is a projection type. More particularly, with the use of urging means 48 in the form of spring or the like, the jam clearance position is retained. When the apparatus is inclined as described hereinbefore, and if the original carriage is a reciprocable type, an original carriage locking means will be required depending on the inclination angle. This may be interrelated with the lever 47.

Figure 12:
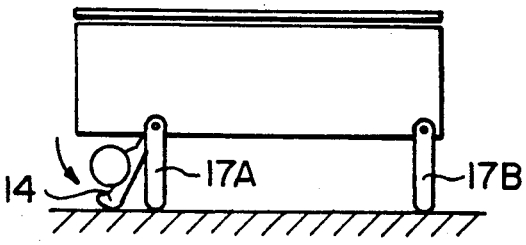
FIG. 12 is a side view of an image forming apparatus according to an eighth embodiment of the present invention.

FIG. 12 shows an eighth embodiment. This Figure shows only the bottom portion of the main assembly, and the other portions are omitted for the sake of simplicity.

In this embodiment, plural levers 47A and 47B are employed to raise the main assembly while keeping the horizontal state of the apparatus.

Figure 13:
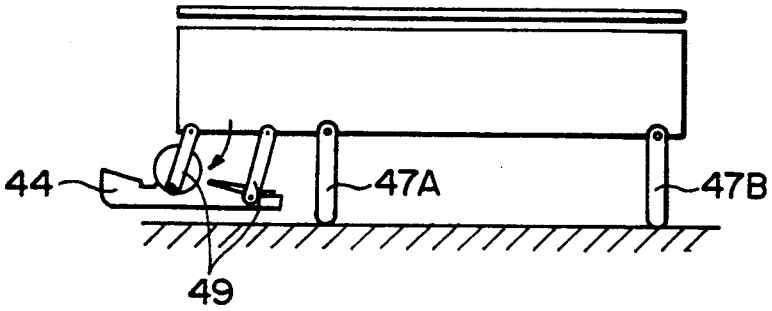
FIG. 13 is a side view of a ninth embodiment of the present invention.

FIG. 13 shows a ninth embodiment. This Figure shows only the bottom portion of the main assembly, and the other portions are omitted for simplicity of explanation.

In this embodiment, the jam clearance unit 44 pops out in the discharging direction.

Figure 14:
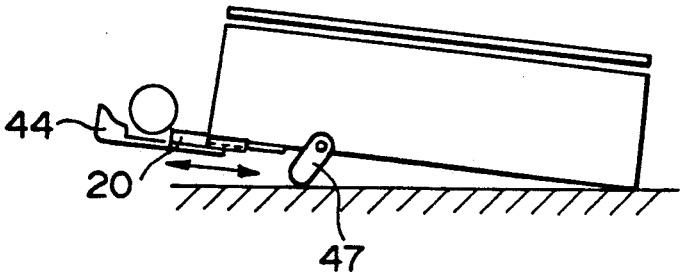
FIG. 14 is a side view of an image forming apparatus according to a tenth embodiment of the present invention.

FIG. 14 shows a tenth embodiment. This Figure shows only the bottom portion of the main assembly of the apparatus, and the other portions are omitted for the sake of simplicity.

In this embodiment, a slidable member 20 is used to improve the jam clearance operativity, and in addition, the upper unit is protected.

Figure 15:
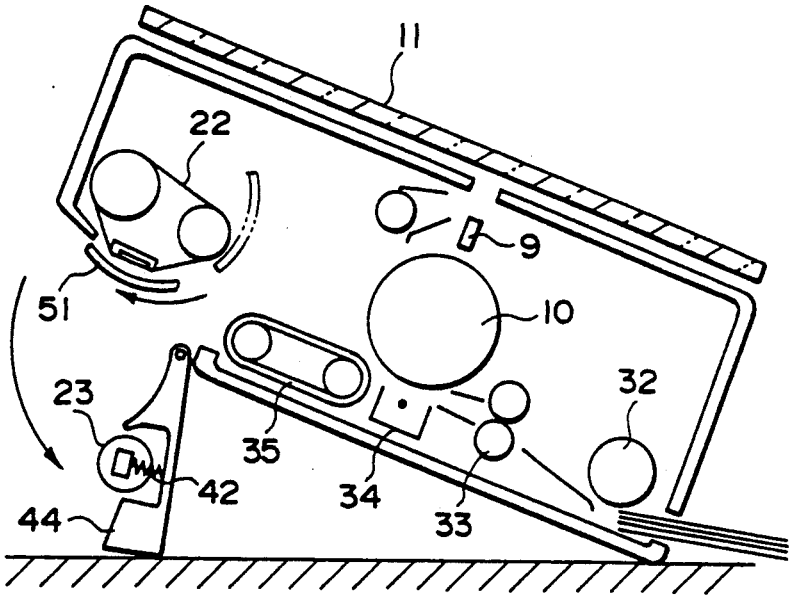
FIG. 15 is a sectional view of an image forming apparatus according to an eleventh embodiment of the present invention in the state of jam clearance operation.

FIG. 15 shows an eleventh embodiment. In this embodiment, the main assembly is protected by the jam clearance unit 44 itself. The retaining means can be omitted, and the operativity is improved. A shutter 51 is also used which is opened in association with the jam clearance operation, by which the protection of the upper unit and the protection of the operator from the high temperature portion, and therefore, the safety is further improved.

The jam clearance unit may include not only the pressing member but also a conveyance guide for guiding the recording material to the nip and the discharging means for discharging the recording material from the nip to the outside of the apparatus. The opening angle and the spacing distance may be determined by skilled in the art properly depending on the size of the apparatus or the like.

While the invention has been described with reference to the structures disclosed herein, it is not confined to the details set forth and this application is intended to cover such modifications or changes as may come within the purposes of the improvements or the scope of the following claims.

We claim:

1. An image forming apparatus, comprising:

image forming means for forming an unfixed image on a recording material;

fixing means for fixing the unfixed image on the recording material, said fixing means including a heater, an endless film having a surface parting layer and a pressing member cooperative with said film to form a nip for receiving the recording material;

means for driving said endless film;

an opening portion for opening said apparatus for permitting a jam clearance operation of a jammed recording material in said fixing means;

wherein lateral movement of said film is inhibited when the film is not driven, and said pressing member and said film are separated from each other in association with opening of said opening portion.

2. An apparatus according to claim 1, wherein said opening portion supports said pressing member, and the separation is effected by movement of said opening portion.

3. An apparatus according to claim 2, wherein said opening portion opens away from said heater.

4. An apparatus according to claim 2, wherein said opening portions opens in a direction of movement of the recording material.

5. An apparatus according to claim 1, wherein said film has a heat resistive base layer and the surface parting layer is on said heat resistive base layer.

6. An apparatus according to claim 5, wherein said surface parting layer has a thickness smaller than that of said base layer.

7. An apparatus according to claim 1, wherein said image forming means includes an image bearing member for carrying the unfixed image and image transfer means for transferring the unfixed image from the image bearing member to the recording material, and wherein an image transfer station having the transfer means is opened by opening said opening portion.

8. An apparatus according to claim 7, wherein said opening portion supports said image bearing member, said heater and said film.

9. An image forming apparatus, comprising:

image forming means for forming an unfixed image on a recording material;

fixing means for fixing the unfixed image on the recording material, said fixing means includes a heater which is stationary in use, a film in sliding contact with said heater and a pressing member cooperable with said film to form a nip for receiving the recording material; and an opening portion for exposing said pressing member while said film is unexposed, wherein said image forming means includes an image bearing member for carrying the unfixed image and image transfer means for transferring the unfixed image from the image bearing member to the recording material, and wherein an image transfer station having the transfer means is opened by opening said opening portion.

10. An apparatus according to claim 9, wherein said opening portion supports said pressing member, and wherein said pressing member is separated from said film by opening said opening portion.

11. An apparatus according to claim 10, wherein said opening portion opens away from said heater.

12. An apparatus according to claim 10, wherein said opening portions opens in a direction of movement of the recording material.

13. An apparatus according to claim 9, wherein said film includes a heat resistive base layer and a surface parting layer on said base layer.

14. An apparatus according to claim 13, wherein said surface parting layer has a thickness smaller than that of said base layer.

15. An apparatus according to claim 9, wherein said opening portion supports said image bearing member, said heater and said film.

16. An image forming apparatus, comprising:

means for forming an unfixed image on a recording material;

fixing means for foxing the unfixed image on the recording material, said fixing means including a heater, a film and a pressing member cooperative with said film to form a nip for receiving the recording material; and an opening portion formed in a frame opposite to said nip from said film.

17. An apparatus according to claim 16, wherein said pressing member is exposed by opening said opening portion.

18. An apparatus according to claim 16, wherein said opening portion supports said pressing member, and the separation is effected by movement of said opening portion.

19. An apparatus according to claim 16, wherein said image forming means includes an image bearing member for carrying the unfixed image, image transfer means for transferring the unfixed image from said image bearing member onto the recording material, wherein a passage for the recording material between the transfer means and said fixing means is opened by opening said opening portion.

20. An apparatus according to claim 19, wherein said opening portion supports a conveyance guide for guiding the recording material from the image transfer means to said image fixing means.

21. An apparatus according to claim 16, wherein said heater is stationary in use, and said film in sliding contact with said heater.

22. An apparatus according to claim 16, wherein said film includes a heat resistive base layer and a surface parting layer contacting the unfixed image on said base layer.

23. An apparatus according to claim 22, wherein said surface parting layer has a thickness smaller than that of said base layer.

* * * * *

UNITED STATES PATENT AND TRADEMARK OFFICE

CERTIFICATE OF CORRECTION

PATENT NO. : 5,291,256
DATED : March 1, 1994
INVENTOR(S) : KAZUSHI KITAJIMA, ET AL.

It is certified that error appears in the above-indentified patent and that said Letters Patent is hereby corrected as shown below:

On the title page, item [30]:
Line FAPD, "Apr. 9, 1991 [JP] Japan 2-076276" should read --Apr. 9, 1991 [JP] Japan 3-076276--.

Column 2,
Line 59, "Figs. 2 and 3 are" should read --Fig. 3 is--; and
Line 60, "views" should read --view--.

Column 3,
Line 50, "ber" should read --bers--.

Column 6,
Line 29, "an" should read --and--.

Column 7,
Line 53, "portions" should read --portion--.

Column 8,
Line 29, "portions" should read --portion--; and
Line 43, "foxing" should read --fixing--.

Signed and Sealed this

Sixth Day of December, 1994

Attest:

Bruce Lehman

BRUCE LEHMAN

Attesting Officer

Commissioner of Patents and Trademarks